United States Patent [19]

Malzacher

[11] 4,333,634

[45] Jun. 8, 1982

[54] GRIPPER ASSEMBLY FOR MOVING DRILLING RIGS

[76] Inventor: Fred H. Malzacher, 5530 Rushmore St., Ventura, Calif. 93003

[21] Appl. No.: 138,329

[22] Filed: Apr. 8, 1980

[51] Int. Cl.[3] ..... B66F 1/00

[52] U.S. Cl. ..... 254/106

[58] Field of Search ..... 254/105-107, 254/29 R, 35-37; 294/85, 88

[56] References Cited

U.S. PATENT DOCUMENTS

| | | | |
|---|---|---|---|
| 3,464,095 | 9/1969 | Chambers | 254/107 X |
| 3,559,954 | 2/1971 | Chambers et al. | 254/106 |
| 4,215,848 | 8/1980 | van de Werken | 254/107 |

*Primary Examiner*—Robert C. Watson
*Attorney, Agent, or Firm*—David O'Reilly

[57] ABSTRACT

A gripping assembly for moving drilling rigs on offshore drilling platforms in which the drilling rigs are supported on a plurality of skid bases. The gripper assembly rests on the skid bases and provides means for selectively gripping the skid base when a drilling rig is to be moved. The gripper assembly has a platform supported by end plates resting on the skid base flanges and is connected to the drilling rig by a hydraulic jack cylinder which moves or slides the drilling rig on the skid bases in a stepwise fashion. Traversing the platform is a cross-member pivotally supporting gripper arms for applying a clamping force to the skid base. The gripper assembly is clamped on the skid base by means of a clamping hydraulic cylinder to apply a force on flanges on the gripper arms, while the hydraulic jack cylinder is operated to push or pull the drilling rig a distance equal to the extension distance of the hydraulic jack cylinder stroke.

10 Claims, 5 Drawing Figures

GRIPPER ASSEMBLY FOR MOVING DRILLING RIGS

BACKGROUND OF THE INVENTION

This invention relates to a gripper assembly and more particularly relates to a gripping assembly for moving drilling rigs supported on offshore drilling platforms.

Offshore drilling platforms are used to drill a number of holes. That is, a single platform will be used to drill or sink numerous wells, sometimes as many as twenty or more from the same platform. Thus, each time a well is sunk, the drilling rig must be repositioned for drilling in a different area. The drilling rig is mounted on skid bases for sliding from position to position for drilling successive wells. Previously a cumbersome and time-consuming mechanical block-and-tackle jacking system was used to move the drilling rig. It would be preferable if such movement could be automated to considerably reduce the time in moving the drilling rig from one position to another.

SUMMARY OF THE INVENTION

The purpose of the present invention is to provide a hydraulically operated gripper assembly which can be used to hydraulically clamp and move a drilling rig on an offshore drilling platform in an efficient step-wise fashion.

The present invention is comprised of a gripper assembly resting on the skid base which supports the drilling rig. The gripper assembly has pivotally mounted gripper arms for clamping flanges on the skid base. The gripper arms are pivotally mounted on a cross-member traversing a support platform resting on the skid base. The cross-member has shoulders extending outboard of the sides of the skid base which permit tremendous forces to be applied to the gripper arms perpendicular to the skid base. The gripper arms are hydraulically clamped by means of a clamping cylinder mounted on the gripper assembly platform. A single-acting, spring-return, clamping hydraulic cylinder has push rods with a holding yoke engaging half-round flanges on the gripper arm. A control system allows actuation or release of the clamp hydraulic cylinder.

The gripper assembly has a boss or connecting ring for a hydraulic jack cylinder which connects the gripper assembly to a drill rig base. Two cylinder connecting clevises are provided at each end of the gripper assembly, so that it can be used to push or pull in either direction without the necessity of completely removing the gripper assembly and turning it around. Thus, it can be used to move one or more drilling rigs mounted on skid bases on an offshore drilling platform. This system is 95% roughneck-resistant therefore saving the user downtime and maintenance cost.

The hydraulic jack cylinder is a double-acting cylinder which can push or pull to move the drilling rig or the gripper assembly, as desired. The drilling rig is moved by actuating the hydraulic jack cylinder in a step-wise fashion. The hydraulic jack cylinder is operated to push or pull the drilling rig on the skid base a length equal to the cylinder stroke. After the drilling rig has been moved a step, the gripper assembly is released and moved a step by retracting the rod of the jack cylinder. The gripper assembly is then again clamped to the skid base and the hydraulic jack cylinder actuated to push or pull the drilling rig a second step. Succeeding steps are accomplished by successive clamping operation of the jack cylinder, release and moving of the gripper assembly and reclamping.

It is one object of the present invention to provide an easily operated gripper assembly for movement of drilling rigs on offshore drilling platforms which is virtually roughneck-resistant.

Another object of the present invention is to provide a gripper assembly which mounts on a skid base of an offshore drilling platform.

Still another object of the present invention is to provide a gripper assembly which is hydraulically operated with ease by one person.

These and other objects of the invention will become apparent from the following detailed description when considered in conjunction with the accompanying drawings wherein like reference numerals identify like parts throughout.

DESCRIPTION OF THE PREFERRED EMBODIMENT

Figure 1:
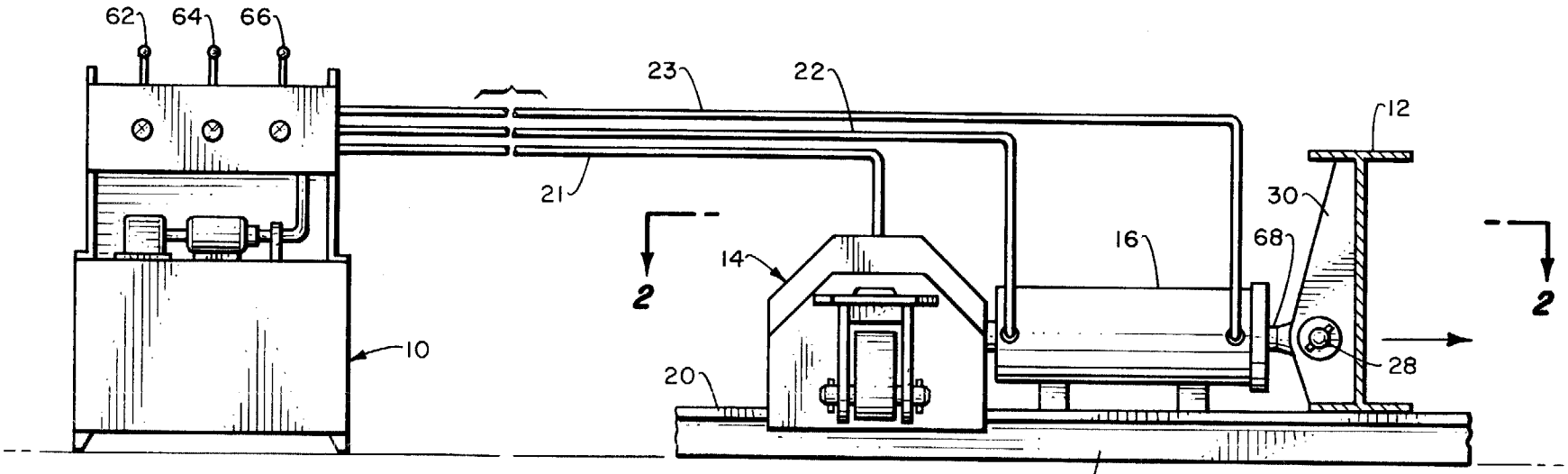
FIG. 1 is a side elevation of a system for moving a drilling rig on offshore drilling platforms, incorporating the gripper assembly of the invention.
Figure 2:
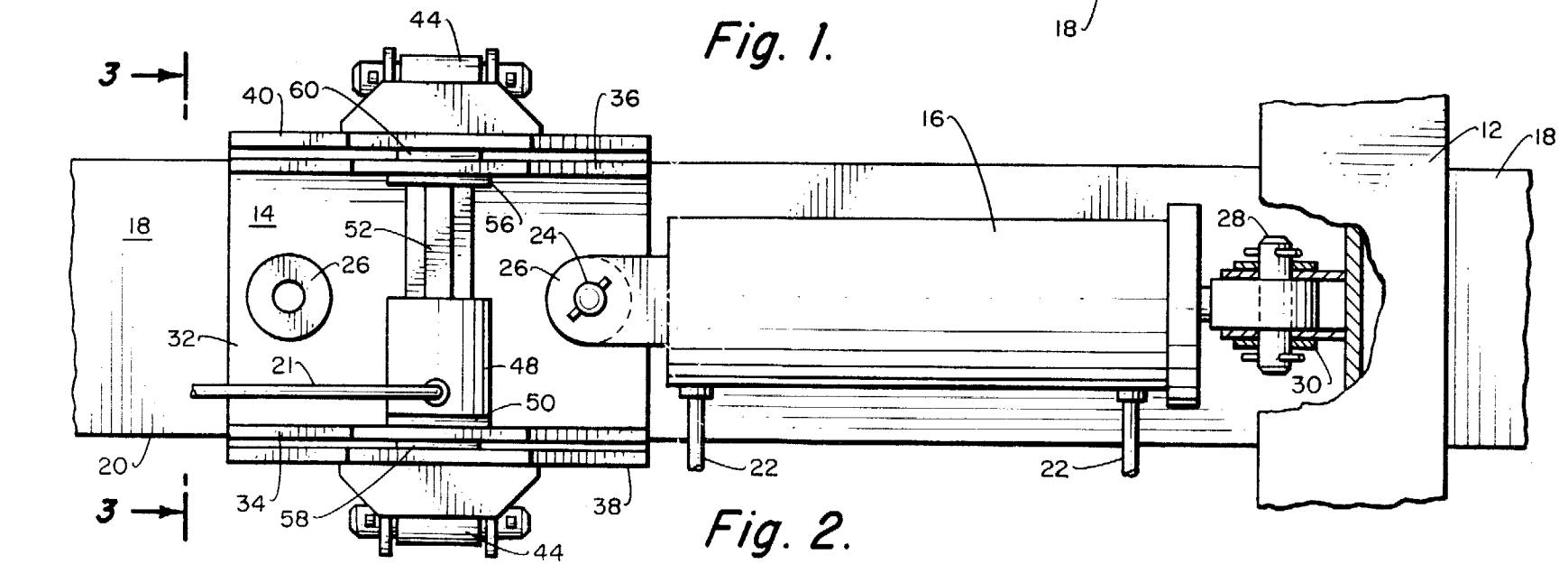
FIG. 2 is a view of the gripping assembly for moving drilling rigs taken at 2—2 of FIG. 1.

Referring to FIGS. 1 and 2, there is shown a system for moving a drilling rig comprised of a control console 10, a drilling rig represented by the beam 12, a gripper assembly 14, and a hydraulic jack cylinder 16, connecting the gripper assembly 14 to the drilling rig 12. The gripper assembly 14, hydraulic jack 16 and drilling rig 12 all are usually supported by two or more skid bases 18 having flanges 20 on either side. Hydraulic lines 21, 22 and 23 connect the hydraulic control console to the gripper assembly 14 and hydraulic jack cylinder 16, respectively.

Hydraulic jack cylinder 16 is connected to the gripper assembly by means of a pin 24 engaging a cylinder mounting boss 26 on the gripper assembly. The opposite end of the hydraulic jack cylinder 16 is likewise connected by pin 28 through flanges 30 attached to the drilling rig support beam 12. The jack cylinder 16 is a double-acting, single-piston jack cylinder having two high-pressure hydraulic hoses 22 and 23 connected to each for operation in either direction which will be described hereinafter.

Figure 3:
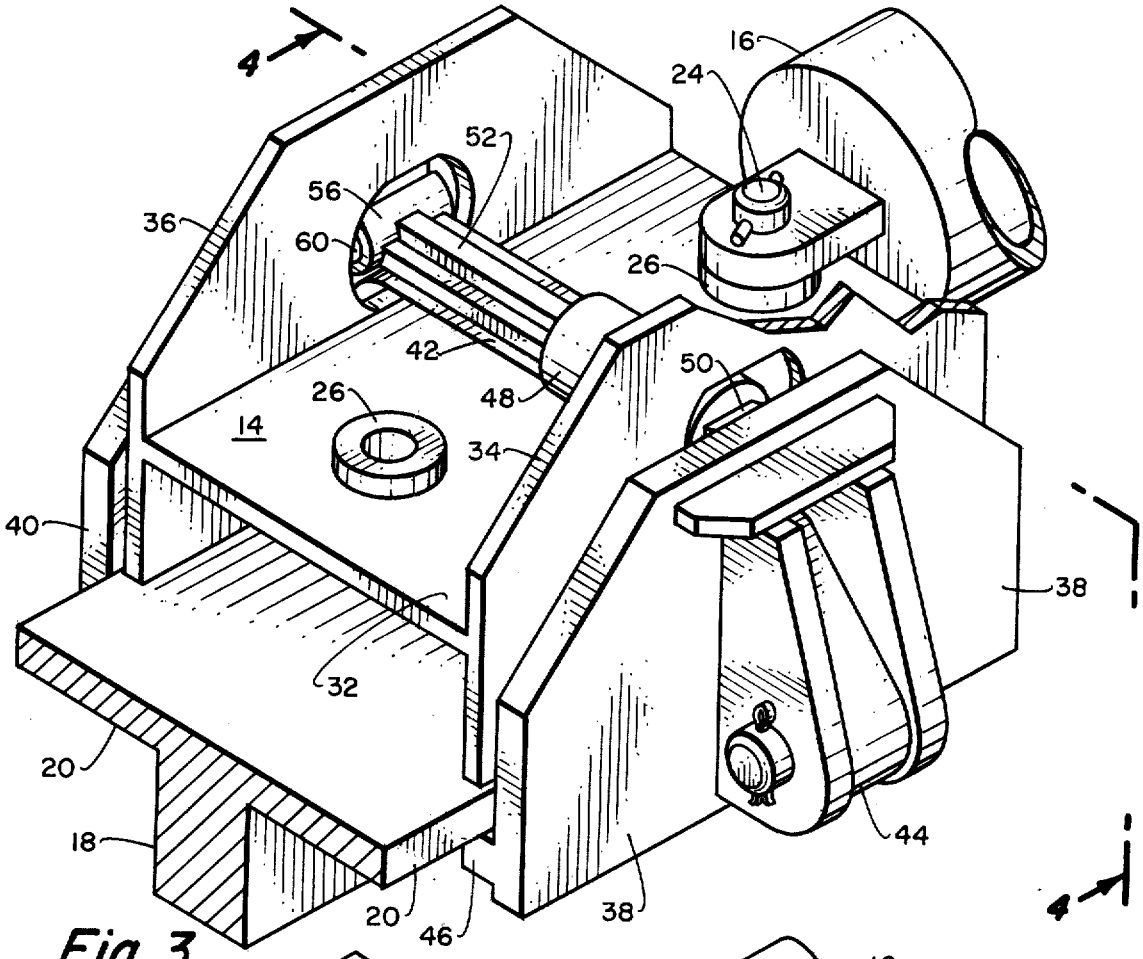
FIG. 3 is a view of the gripper assembly for moving drilling rigs taken at 3—3 of FIG. 2.
Figure 4:
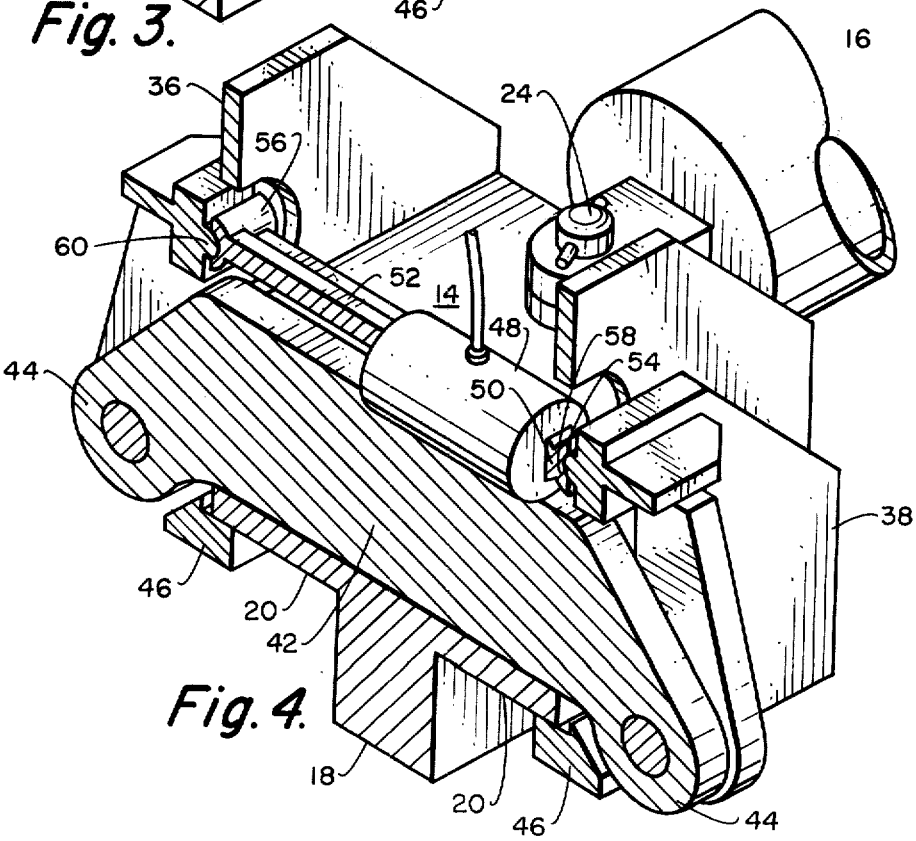
FIG. 4 is a sectional view of the gripper assembly taken at 4—4 of FIG. 3.

The system disclosed and described in FIG. 1 can be used for efficient movement of the drilling rig 12 because of the unique design of the gripper assembly 14. The gripper assembly is illustrated in the detail and sectional views of FIGS. 3 and 4, respectively. The gripper assembly 14 is comprised of a horizontal shelf or platform 32 supported by end plates 34 and 36 forming a cantilever support frame which rest on flanges 20 of the skid base 18. Gripper connecting arms 38 and 40 are pivotally mounted on a cantilevered cross-member 42 having pin mounting where pivot pins 45 shoulder extensions 44. The cantilevered gripper arms are provided with gripping flanges 46 which press against the underside of skid base flanges 20 to clamp the gripper assembly when operated. The cross-member shoulders 44 extend outboard of the skid base 18 and provide a strong sturdy cantilevered mounting for the gripper arms. The cross-member acts as a fulcrum connecting the two gripper arms and concentrate the forces in a vertical plane allowing the application of tremendous force on the skid base.

The gripper arms 38 are operated by a clamping hydraulic load expansion cylinder 48 which is single-acting, spring-retracting hydraulic cylinder having opposite-acting push rods 50 and 52, and a single, high-pressure hydraulic hose 21. The push rods are provided with yokes 54 and 56 which mate with half-round flanges 58 and 60 incorporated into the gripper arms 38. When clamping hydraulic cylinder 48 is operated, the push rods 50 and 52 exert tremendous force on the gripper arms 38 and 40 by means of the yokes 54 and 56, exerting pressure on the half-round ridges 58 and 60. Thus, the gripper assembly 14 is securely clamped to the skid base 18 by means of the forces exerted between the bottom edges of end plates 34 and 36 and the flanges 46 on the gripper arms 38.

Figure 5:
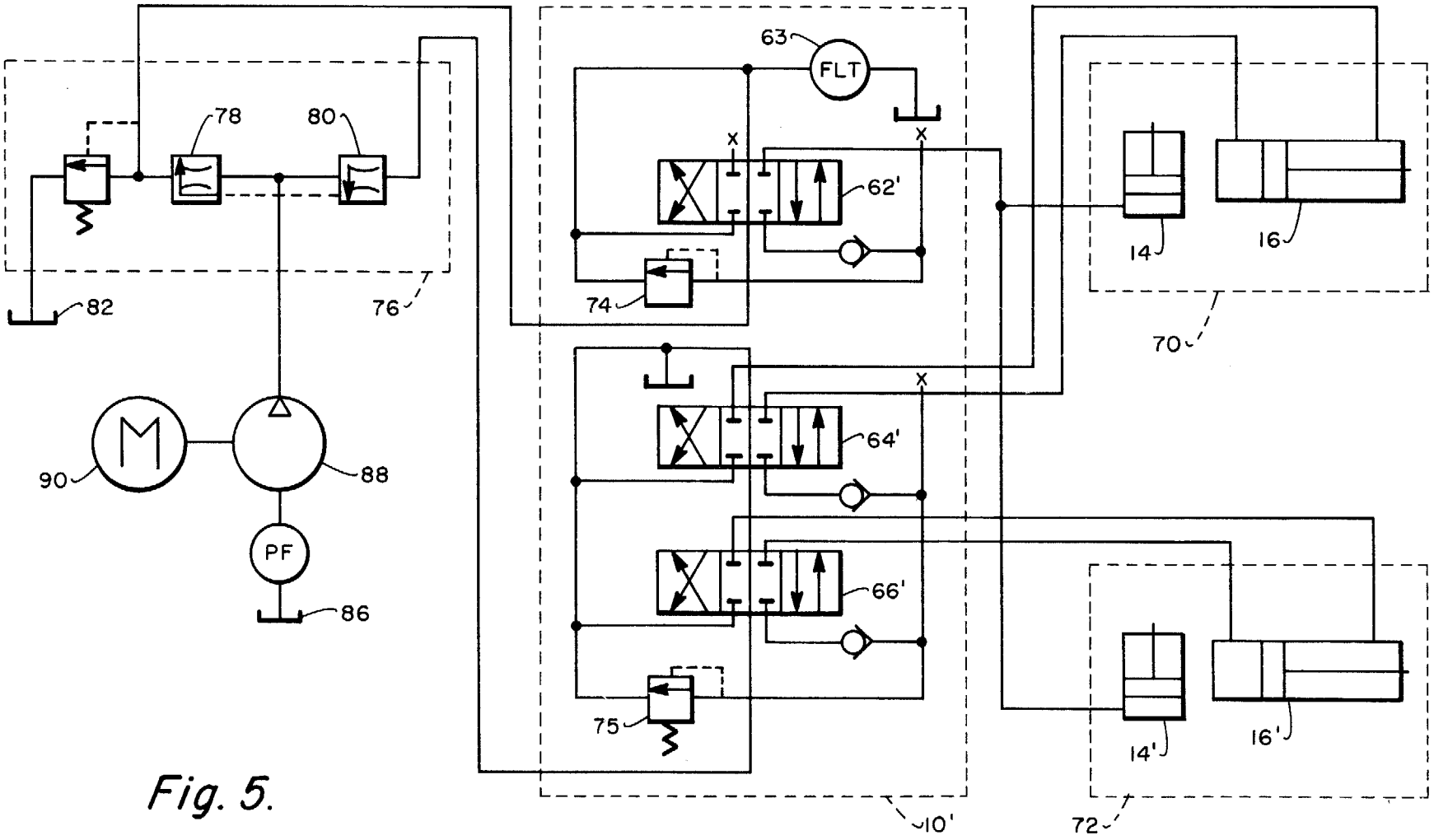
FIG. 5 is a schematic diagram of the gripper assembly hydraulics adapted to move a drilling rig.

The movement of the drilling rig 12 is accomplished in the following manner. Control console 10 has control levers 62,64 and 66 for operating the high-pressure hydraulic hoses 22. The control lever 66 is for operating a second gripper in tandem with the gripper 14 shown in FIG. 1 which will be described in greater detail hereinafter. One of the control arms is operated to actuate the clamping hydraulic load expansion cylinder 48, clamping the gripper arms 38 to the flanges 20 of skid base 18. Control lever 64 is then operated to actuate the hydraulic jack cylinder 16, causing cylinder rod 68 to extend to move the drilling rig 12 along the skid base 18. When the push rod 68 is fully extended clamping cylinder 48 may be released, unclamping the gripper assembly from the skid base. The push rod 68 is then retracted by operating lever 64 in the opposite direction to control the flow of hydraulic fluid through line 23 to the front end of the hydraulic jack cylinder 16. This retracts the push rod 68 and simultaneously moves the gripper assembly 14 and hydraulic jack cylinder toward the drilling rig 12. This process can be accomplished in reverse by pulling as well as pushing. The clamping hydraulic load expansion cylinder 48 may now again be actuated to clamp the gripper assembly on the skid base 18 for the next successive step-wise movement of the drilling rig 12. Generally, two grippers are utilized to move the drilling rig by jockeying them back and forth. The hydraulic schematic diagram of FIG. 5 illustrates the operation of the two cooperating grippers. In this figure, there are shown gripper assemblies 70 and 72 comprised of two grippers, 14 and 14' and hydraulic jacks 16 and 16'. Simultaneous control of the gripper assemblies is achieved through the hydraulic control console 10' having contol valves 62', 64', and 66' for controlling grippers 14 and 14' and hydraulic jacks 16 and 16'.

The hydraulic control console 10' includes flow control valves 62', 64', 66', and adjustable flow control valves 74 and 75. The control valve 62' is a single-acting valve for controlling the grippers 14 and 14', including a filter 63, with double-acting valves 64' and 66' for operating the hydraulic jacks independently for moving a drilling rig. The adjustable relief valve 74 is for balancing the force applied to grippers 14 and 14'.

The lever 62 (FIG. 1) is a cantilevered lockout lever for simultaneous operation of both grippers with balancing adjustment provided by adjustable control valve 74. The lever 62 is for locking or releasing the clamping action of the grippers 14 and 14' on the skid base. The levers 64 and 66 operate double-acting valves 64' and 66' for independently controlling the left skid hydraulic cylinder and right skid hydraulic cylinder respectively. That is, these levers operate double-acting valves to operate the double-acting hydraulic cylinders in a push-/pull manner.

The hydraulic control system also includes a flow control arrangement 76 comprised of adjustable restrictions 78 and 80, a reservoir 82 for delivering hydraulic fluid from reservoir 86 by means of a pump 88 driven by motor 90.

Separate control valves 64' and 66' are provided to independently operate each hydraulic jack to jockey or "walk" the drilling rig along the skid base. The grippers 14 and 14' are clamped by operation of lock out lever 62 which actuates valve 62' and simultaneously controls the flow of hydraulic fluid to grippers 14 and 14'. The levers 64 and 66 controlling valves 64' and 66' are then operated to actuate hydraulic jacks 16 and 16' respectively. More pressure may be applied to one hydraulic jack than the other to break the drilling rig free to start it moving and then hydraulic pressure constantly applied to move the drilling rig the limit of the hydraulic jacks. If during movement, either one of the grippers slips, the relief valve 74 may be adjusted to balance the clamping force on the grippers. The separate adjustable relief valve 74 for gripper jack adjustment is preferably a hand adjustable valve mounted in the control console 10.

A second connecting ring or boss 26 is provided on the other end of shelf 32 so that the gripper assembly can be used to push or pull in either direction without removing the gripper assembly from the skid base 18. The jack cylinder 16 may either be moved or a second jack cylinder attached.

Thus, there has been disclosed a novel system for efficient movement of drilling rigs on offshore drilling platforms incorporating a hydraulically operated gripper assembly for successive step-wise operating in movement of the drilling rig.

Obviously, many modifications and variations of the present invention are possible in light of the above teachings. It is therefore to be understood that the invention may be practiced otherwise than as described and claimed herein.

What is claimed is:

1. A gripping assembly for moving drilling rigs supported on a flanged skid base of a drilling platform comprising:

a support frame comprised of a platform joining end plates resting on the flanges of said skid base;

a cross-member traversing said support frame having cantilevered shoulder extensions extending outboard of the flanges of said skid base;

gripper connecting arms pivotally mounted on said shoulder extensions having gripping flanges adapted to press against the underside of said skid base flanges;

clamping load expansion hydraulic means for applying a force to said gripper connecting arms whereby said arms apply a clamping force on said skid base flanges between the edges of said end plates and said connecting arm gripper flanges;

hydraulic jack means connecting said support frame to said drilling rig for moving said drilling rig while said gripper assembly is clamped to the flanges of said skid base.

2. The drilling rig moving system according to claim 1 wherein said platform comprises:

a pair of horizontal plates secured between said end plates; and each horizontal plate including a boss for attaching said hydraulic jack means for moving said drilling rig.

3. The gripping assembly according to claim 1 wherein said clamping load expansion hydraulic means for applying a force to said gripping arms comprises:

a single-acting, spring-return hydraulic cylinder;

yoke means engaging the ends of said gripping arms; and a pair of connecting rods connecting said yokes to said single-acting, spring-return hydraulic cylinder.

4. The gripping assembly according to claim 3 wherein said gripper connecting arms include a half-round flange for engagement by said yoke for uniform application of force to said gripper arms.

5. The gripping assembly according to claim 1 wherein said clamping hydraulic load expansion means for applying a force to said gripper connecting arms comprises:

a single-acting, spring-return hydraulic cylinder;

yoke means engaging the ends of said gripping arms; and a pair of connecting rods connecting said yokes to said single-acting, spring-return hydraulic cylinder.

6. The gripping assembly according to claim 5 wherein said gripper arms each include a half-round flange for engagement by said yoke for uniform application of force to said gripper arms.

7. A system for moving drilling rigs on offshore drilling platforms comprising:

a plurality of flanged skid bases, said drilling rig resting on said skid bases;

a plurality of gripping assemblies for gripping said skid bases while the drilling rig is being moved;

a hydraulic jack cylinder for connecting said drilling rig to each of said gripping assemblies;

control means for controlling the successive clamping and release of said gripper assemblies and actuation of said jack cylinder;

said gripping assemblies comprising:

a support frame comprised of a platform joining end plates resting on the flanges of said skid base;

a cross-member traversing said support frame having cantilevered shoulder extensions extending outboard of the flanges of said skid base;

gripper connecting arms pivotally mounted on said shoulder extensions having gripping flanges adapted to press against the underside of said skid base flanges;

clamping load expansion hydraulic means for applying a force to said gripper connecting arms whereby said arms apply a clamping force on said skid base flanges between the edges of said end plates and said connecting arm gripper flanges;

means for successively clamping and releasing said clamping load expansion hydraulic means for step-wise movement of said drilling rig; and said step-wise movements being accomplished by hydraulically actuating said jack cylinder while said gripper assemblies are clamped to said skid base flanges.

8. The drilling rig moving system according to claim 7 wherein said means for applying a force to said gripper arms comprises:

a single-acting, spring-return hydraulic cylinder;

yoke means engaging the ends of said gripping arms; and a pair of connecting rods connecting said yokes to said single-acting, spring-return hydraulic cylinder.

9. The drilling rig moving system according to claim 8 wherein said gripper arms each include a half-round flange for engagement by said yoke for uniform application of force to said gripper arms.

10. The drilling rig moving system according to claim 9 wherein said cantilevered support frame comprises:

a pair of end plates secured over said cantilevered cross-member and resting on said skid base;

a pair of horizontal plates secured between said end plates; and each horizontal plate including a cylinder mounting boss for attaching said hydraulic jack means for moving said drilling rig.

* * * * *